US008028538B2

(12) United States Patent
Kim et al.

(10) Patent No.: US 8,028,538 B2
(45) Date of Patent: Oct. 4, 2011

(54) REFRIGERATOR WITH TEMPERATURE CONTROL AND OPERATING METHOD THEREFOR

(75) Inventors: Yoon-young Kim, Suwon-si (KR); Dong-nyeol Ryu, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 421 days.

(21) Appl. No.: 11/653,228

(22) Filed: Jan. 16, 2007

(65) Prior Publication Data

US 2007/0163291 A1 Jul. 19, 2007

(30) Foreign Application Priority Data

Jan. 18, 2006 (KR) ..... 10-2006-0005490
Jan. 18, 2006 (KR) ..... 10-2006-0005491

(51) Int. Cl.
*F25D 17/04* (2006.01)
*F25D 17/06* (2006.01)

(52) U.S. Cl. ..... 62/408; 62/419; 62/187

(58) Field of Classification Search ..... 62/408, 62/382, 419, 413–414, 187
See application file for complete search history.

(56) References Cited

U.S. PATENT DOCUMENTS

| | | | | |
|---|---|---|---|---|
| 5,228,499 | A * | 7/1993 | Yoon | 165/263 |
| 5,388,427 | A * | 2/1995 | Lee | 62/331 |
| 6,412,286 | B1 * | 7/2002 | Park et al. | 62/3.6 |
| 2002/0104325 | A1 * | 8/2002 | Mandel et al. | 62/187 |
| 2004/0107726 | A1 * | 6/2004 | Kim et al. | 62/441 |
| 2005/0016202 | A1 * | 1/2005 | Ko et al. | 62/441 |

FOREIGN PATENT DOCUMENTS

| | | |
|---|---|---|
| CN | 1085648 | 4/1994 |
| KR | 10-2002-0067178 | 8/2002 |
| KR | 10-2002-0084466 | 11/2002 |
| KR | 10-2004-0049591 | 6/2004 |
| KR | 10-2005-0028266 | 3/2005 |

OTHER PUBLICATIONS

Korean Office Action for Application No. 10-2006-0005491, dated Dec. 19, 2006.
Office Action issued in Aug. 8, 2008 in corresponding Chinese Patent Application No. 200710002265.5.

* cited by examiner

*Primary Examiner* — Frantz Jules
*Assistant Examiner* — Cassey D Bauer
(74) *Attorney, Agent, or Firm* — Staas & Halsey LLP

(57) ABSTRACT

A refrigerator having a main body including a refrigerating compartment, a cool air duct supplying cool air to the refrigerating compartment, and a sub storage compartment provided in the main body independently maintaining a temperature thereof with respect to the refrigerating compartment and being indirectly cooled or indirectly heated by radiation.

6 Claims, 13 Drawing Sheets

REFRIGERATOR WITH TEMPERATURE CONTROL AND OPERATING METHOD THEREFOR

CROSS-REFERENCE TO RELATED APPLICATIONS

This application claims priority from Korean Patent Application Nos. 2006-0005490, filed on Jan. 18, 2006 and 2006-0005491, filed on Jan. 18, 2006, in the Korean Intellectual Property Office, the disclosures of which are incorporated herein by reference.

BACKGROUND OF THE INVENTION

1. Field of the Invention

The present invention relates to a refrigerator and an operating method therefor, and more particularly, a refrigerator and an operating method therefor controlling the temperature of a sub storage compartment separately provided to a main body.

2. Description of the Related Art

Generally, a refrigerator generates cool air through a cooling cycle to preserve food for a period of time, and includes a freezing compartment storing food frozen below the freezing point, a refrigerating compartment storing food refrigerated above the freezing point, and a cooling system cooling the freezing compartment and the refrigerating compartment.

Korean Patent Publication No. 2004-49591 discloses a refrigerator provided with an independent compartment, the temperature of which is independently controlled with respect to a refrigerating compartment and a freezing compartment. The refrigerator includes a casing forming the independent compartment, such as a temperature converting compartment, a cool air flowing hole formed in the casing to be connected with the freezing compartment, a heater heating an inside of the casing, and a controller controlling the heater. If the independent compartment needs to have a temperature higher than the refrigerating compartment, the controller operates the heater so that the temperature of the independent compartment increases. If the independent compartment needs to have a temperature lower than the refrigerating compartment, a fan provided in the refrigerating compartment or the freezing compartment is operated to supply cool air inside the refrigerating compartment or the freezing compartment to the independent compartment through the cool air flowing hole so that the temperature of the independent compartment decreases.

However, in the conventional refrigerator, cool air and heat are directly supplied into the independent compartment to be contacted to food stored therein, and accordingly, moisture for the food is evaporated, which thereby deteriorates freshness of the food.

FIG. 10 illustrates the temperature variation of a sub storage compartment (not shown) according to a conventional operating method for a conventional refrigerator (not shown). Referring to FIG. 10, a sub storage compartment according to a conventional operating method for a conventional refrigerator is forcedly heated to reach an upper limit temperature, and then the sub storage compartment is forcedly cooled to reach a lower limit temperature.

Also, in the case that the temperature of the independent compartment needs to be decreased after the heater is operated to increase the temperature thereof, the fan of the refrigerating compartment or the freezing compartment needs to be operated, thereby increasing power consumption.

Also, in the case that the temperature of the independent compartment needs be increased after cool air is supplied to decrease the temperature thereof, the heater needs to be operated, thereby increasing power consumption.

Also, in the case that the temperature of the independent compartment needs to be increased while the refrigerating compartment or the freezing compartment is cooled, the heater and the fan must be simultaneously operated, thereby deteriorating energy efficiency.

SUMMARY OF THE INVENTION

Accordingly, it is an aspect of present invention to provide a refrigerator and an operating method therefor minimizing unnecessary cooling and heating operations and therefore minimizing temperature variation, thereby enhancing the freshness of food.

Also, it is another aspect of the present invention to provide a refrigerator and an operating method therefor to prevent a cooling operation and a heating operation from being simultaneously operated, thereby enhancing energy efficiency.

Additional aspects and/or advantages of the invention will be set forth in part in the description which follows and, in part, will be apparent from the description, or may be learned by practice of the invention.

The foregoing and/or other aspects of the present invention can be achieved by providing a refrigerator having a main body including a refrigerating compartment, a cool air duct supplying cool air to the refrigerating compartment, and a sub storage compartment provided in the main body independently maintaining a temperature thereof with respect to the refrigerating compartment and being indirectly cooled or indirectly heated by radiation.

According to a first embodiment of the present invention, the sub storage compartment includes a separate accommodating part having a space defined therein, and a heat transferring member surrounding at least a part of the separate accommodating part and transferring heat or cold heat by radiation to the separate accommodating part.

According to the first embodiment of the present invention, the separate accommodating part includes an opening through which heat or cold heat is transferred by radiation.

According to the first embodiment of the present invention, the sub storage compartment further includes a sub cool air duct connected with the cool air duct to supply cool air to the heat transferring member, a damper opening and closing a connection between the sub cool air duct and the cool air duct, and a heater supplying heat to the heat transferring member.

According to the first embodiment of the present invention, the sub storage compartment includes an insulation member surrounding at least a part of the heat transferring member to insulate the separate accommodating part from the refrigerating compartment, and an outer casing forming an external appearance of the sub storage compartment, and the sub cool air duct forms a space between the heat transferring member and the insulating member.

According to the first embodiment of the present invention, the insulating member comprises a cool air inlet through which cool air flows in the sub cool air duct, and a cool air outlet through which a warmed air flows out of the sub cool air duct.

According to the first embodiment of the present invention, the heater is interposed between the heat transferring member and the insulating member.

According to the first embodiment of the present invention, the heat transferring member includes at least one of aluminum and copper.

According to the first embodiment of the present invention, the separate accommodating part is inclined so that water condensed thereto flows down the separate accommodating part.

The foregoing and/or other aspects of the first embodiment of the present invention can be achieved by providing a refrigerator having a main body including a refrigerating compartment and a cool air duct supplying cool air to the refrigerating compartment, including a sub storage compartment provided in the main body of the refrigerator to independently maintain a temperature thereof with respect to the refrigerating compartment, the sub storage compartment having a separate accommodating part having a space formed therein including an opening through which heat or cold heat is transferred by radiation, and a heat transferring member surrounding at least a part of the separate accommodating part and transferring heat or cold heat by radiation to the separate accommodating part.

According to the first embodiment of the present invention, the sub storage compartment comprises a sub cool air duct connected with the cool air duct to supply cool air to the heat transferring member, and a damper controlling cool air supply of the sub cool air duct.

According to the first embodiment of the present invention, the sub storage compartment includes an insulation member surrounding at least a part of the heat transferring member to insulate the separate accommodating part from the refrigerating compartment, and an outer casing forming an external appearance of the sub storage compartment, and the sub cool air duct includes a space between the heat transferring member and the insulating member.

According to the first embodiment of the present invention, the separate accommodating part is inclined so that water condensed to an inner side thereof flows down the separate accommodating part.

The foregoing and/or other aspects of the first embodiment of the present invention can be achieved by providing a refrigerator having a main body including a refrigerating compartment and a cool air duct supplying cool air to the refrigerating compartment, including a sub storage compartment provided in the main body to independently maintain a temperature thereof with respect to the refrigerating compartment, a damper controlling cool air supply from the cool air duct to the sub storage compartment, a heater supplying heat to the sub storage compartment, and a control part determining a maximum temperature and an upper limit temperature based on a set temperature inputted for the sub storage compartment and turning off the heater so that the sub storage compartment is naturally cooled by a temperature difference between the sub storage compartment and the refrigerating compartment if the temperature of the sub storage compartment reaches the maximum temperature when the sub storage compartment is forcedly heated.

According to the first embodiment of the present invention, the control part determines a minimum temperature and a lower limit temperature based on the set temperature, and turns on the heater at the minimum temperature if the sub storage compartment is naturally cooled after the heater is turned off.

According to the first embodiment of the present invention, the control part opens the damper to forcedly cool the sub storage compartment if the sub storage compartment is naturally heated to reach the upper limit temperature by the temperature difference between the sub storage compartment after the heater is turned off and the refrigerating compartment to reach the upper limit temperature.

According to the first embodiment of the present invention, the control part determines a minimum temperature and a lower limit temperature based on the set temperature, and closes the damper if the temperature of the sub storage compartment reaches the minimum temperature when the sub storage compartment is forcedly cooling.

According to the first embodiment of the present invention, the control part opens the damper to forcedly cool the sub storage compartment if the sub storage compartment is naturally heated to reach the upper limit temperature after the damper is closed.

According to the first embodiment of the present invention, the control part turns on the heater to forcedly heat the sub storage compartment if the sub storage compartment is naturally cooled to reach the lower limit temperature after the damper is closed.

According to the first embodiment of the present invention, the upper limit temperature is higher than the maximum temperature by 1 degree Celsius.

According to the embodiment of the present invention, the lower limit temperature is lower than the minimum temperature by 1 degree Celsius.

The foregoing and/or other aspects of the present invention can be achieved by providing a refrigerator having a main body including a refrigerating compartment and a cool air duct supplying cool air to the refrigerating compartment, including a sub storage compartment provided in the main body to independently maintain a temperature thereof with respect to the refrigerating compartment, a damper controlling cool air supply from the cool air duct to the sub storage compartment, a heater supplying heat to the sub storage compartment, and a control part determining a minimum temperature and a lower limit temperature based on a set temperature inputted for the sub storage compartment and closing the damper if the temperature of the sub storage compartment reaches the minimum temperature when the sub storage compartment is forcedly cooled.

According to the first embodiment of the present invention, the control part turns on the heater to forcedly heat the sub storage compartment if the sub storage compartment is naturally cooled to reach the lower limit temperature by a temperature difference between the sub storage compartment and the refrigerating compartment after the damper is closed.

According to the first embodiment of the present invention, the control part determines a maximum temperature and an upper limit temperature based on the set temperature, and opens the damper to forcedly cool the sub storage compartment if the sub storage compartment is naturally heated by the temperature difference between the sub storage compartment and the refrigerating compartment to reach the upper limit temperature after the damper is closed.

The foregoing and/or other aspects of a second embodiment of the present invention can be achieved by providing an operating method for a refrigerator having a main body including a refrigerating compartment and a sub storage compartment provided inside the refrigerating compartment and having a cool air supplying part and a heat supplying part, including receiving a set temperature for the sub storage compartment, determining a maximum temperature, an upper limit temperature, a minimum temperature and a lower limit temperature based on the set temperature, sensing the temperature of the sub storage compartment, forcedly heating the sub storage compartment through the heat supplying part if the sensed temperature of the sub storage compartment is equal to or lower than the lower limit temperature, and stopping forcedly heating the sub storage compartment if the temperature of the sub storage compartment reaches the maximum temperature.

According to the first embodiment of the present invention, the operating method for the refrigerator further includes forcedly heating the sub storage compartment through the heat supplying part if the temperature of the sub storage compartment reaches the minimum temperature after stopping forcedly heating the sub storage compartment.

According to the second embodiment of the present invention, the operating method for the refrigerator further includes forcedly cooling the sub storage compartment through the cool air supplying part if the temperature of the sub storage compartment reaches the upper limit temperature after stopping forcedly heating the sub storage compartment.

According to the second embodiment of the present invention, the operating method for the refrigerator further includes stopping forcedly cooling the sub storage compartment if the temperature of the sub storage compartment reaches the minimum temperature.

According to the second embodiment of the present invention, the operating method for the refrigerator further includes forcedly heating the sub storage compartment through the heat supplying part if the temperature of the sub storage compartment reaches the lower limit temperature after stopping forcedly cooling the sub storage compartment.

According to the second embodiment of the present invention, the operating method for the refrigerator further includes forcedly cooling the sub storage compartment through the cool air supplying part if the temperature of the sub storage compartment reaches the upper limit temperature after stopping forcedly cooling the sub storage compartment.

According to the second embodiment of the present invention, forcedly heating the sub storage compartment includes determining whether the refrigerating compartment is supplied with cool air if the sensed temperature of the sub storage compartment is lower than or equal to the lower limit temperature and forcedly heating the sub storage compartment through the heat supplying part only if the refrigerating compartment is not supplied with cool air.

According to the second embodiment of the present invention, forcedly heating the sub storage compartment includes determining whether the refrigerating compartment is supplied with cool air if the sensed temperature of the sub storage compartment is lower than or equal to the minimum temperature and forcedly heating the sub storage compartment through the heat supplying part only if the refrigerating compartment is not supplied with cool air.

The foregoing and/or other aspects of the present invention can be achieved by providing an operating method for a refrigerator having a main body including a refrigerating compartment and a sub storage compartment provided inside the refrigerating compartment and having a cool air supplying part and a heat supplying part, including receiving a set temperature for the sub storage compartment, determining a maximum temperature, an upper limit temperature, a minimum temperature and a lower limit temperature based on the set temperature, sensing the temperature of the sub storage compartment, forcedly cooling the sub storage compartment through the cool air supplying part if the sensed temperature of the sub storage compartment is equal to or higher than the upper limit temperature, and stopping forcedly cooling the sub storage compartment if the temperature of the sub storage compartment reaches the minimum temperature.

According to the first embodiment of the present invention, the operating method for the refrigerator further includes forcedly heating the sub storage compartment through the heat supplying part if the temperature of the sub storage compartment reaches the lower limit temperature after stopping forcedly cooling the sub storage compartment.

According to the first embodiment of the present invention, the operating method for the refrigerator further includes forcedly cooling the sub storage compartment through the cool air supplying part if the temperature of the sub storage compartment reaches the upper limit temperature after stopping forcedly cooling the sub storage compartment.

According to the second embodiment of the present invention, forcedly heating the sub storage compartment includes determining whether the refrigerating compartment is supplied with cool air if the sensed temperature of the sub storage compartment is equal to or lower than the lower limit temperature, and forcedly heating the sub storage compartment through the heat supplying part only if the refrigerating compartment is not supplied with cool air.

The foregoing and/or other aspects of the present invention can be achieved by providing an operating method for a refrigerator having a main body including a refrigerating compartment, and a sub storage compartment provided inside the refrigerating compartment and having a cool air supplying part and a heat supplying part, including receiving a set temperature for the sub storage compartment, determining a maximum temperature, an upper limit temperature, a minimum temperature and a lower limit temperature based on the set temperature, sensing the temperature of the sub storage compartment, determining whether the refrigerating compartment is supplied with cool air if the sensed temperature of the sub storage compartment is equal to or lower than the lower limit temperature, and forcedly heating the sub storage compartment through the heat supplying part only if the refrigerating compartment is not supplied with cool air.

According to the second embodiment of the present invention, determining whether the refrigerating compartment is supplied with cool air includes determining whether at least one of a compressor and a fan of the refrigerating compartment is operated or not.

BRIEF DESCRIPTION OF THE DRAWINGS

The above and/or other aspects and advantages of the invention will become apparent and more readily appreciated from the following description of the embodiments, taken in conjunction with the accompanying drawings, in which.

DETAILED DESCRIPTION OF THE PREFERRED EMBODIMENTS

Figure 1:
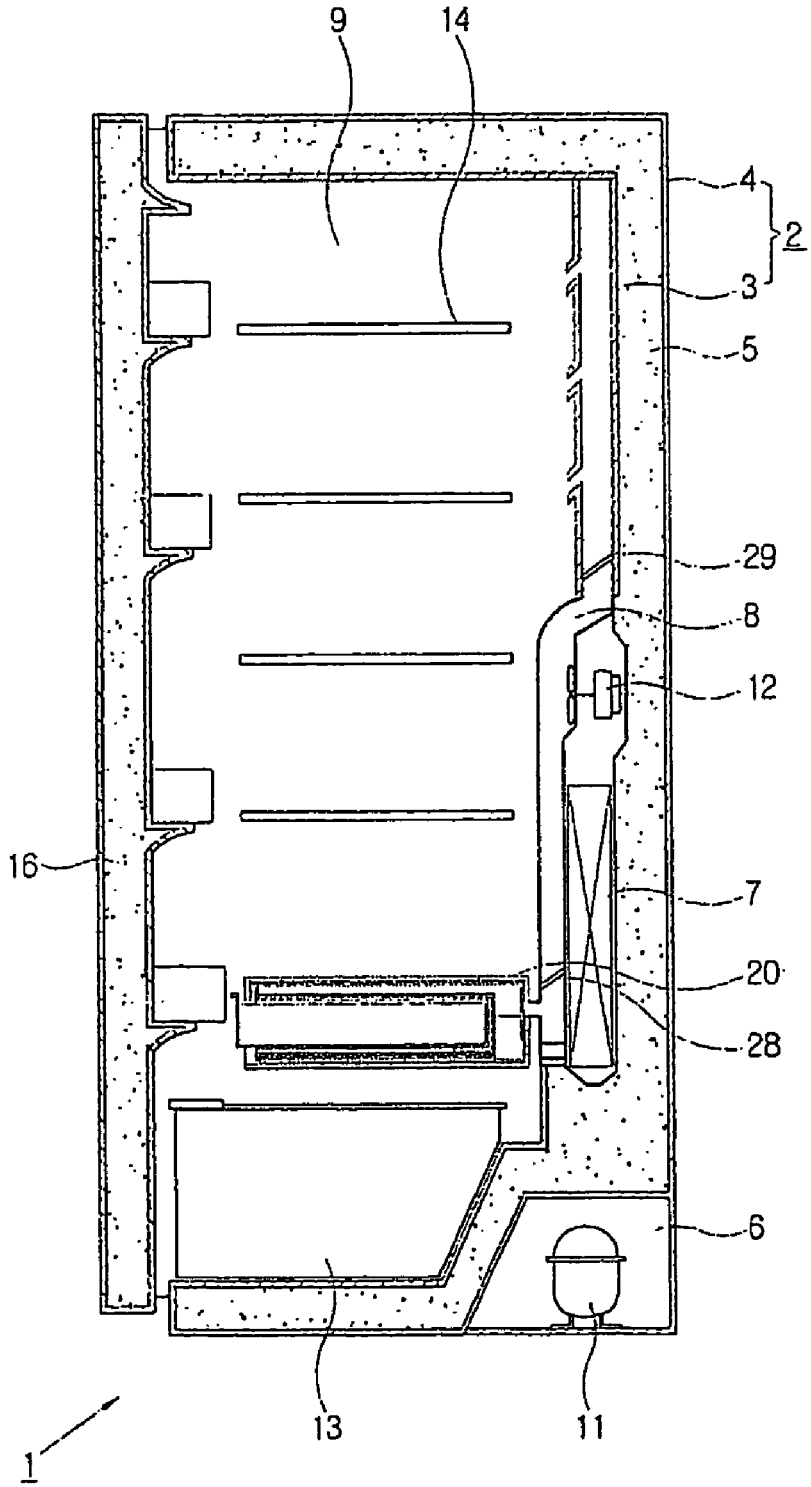
FIG. 1 is a sectional view illustrating a refrigerator according to a first embodiment of the present invention.

Reference will now be made in detail to the embodiments of the present invention, examples of which are illustrated in the accompanying drawings, wherein like reference numerals refer to like elements throughout. The embodiments are described below so as to explain the present invention by referring to the figures.

Figure 2:
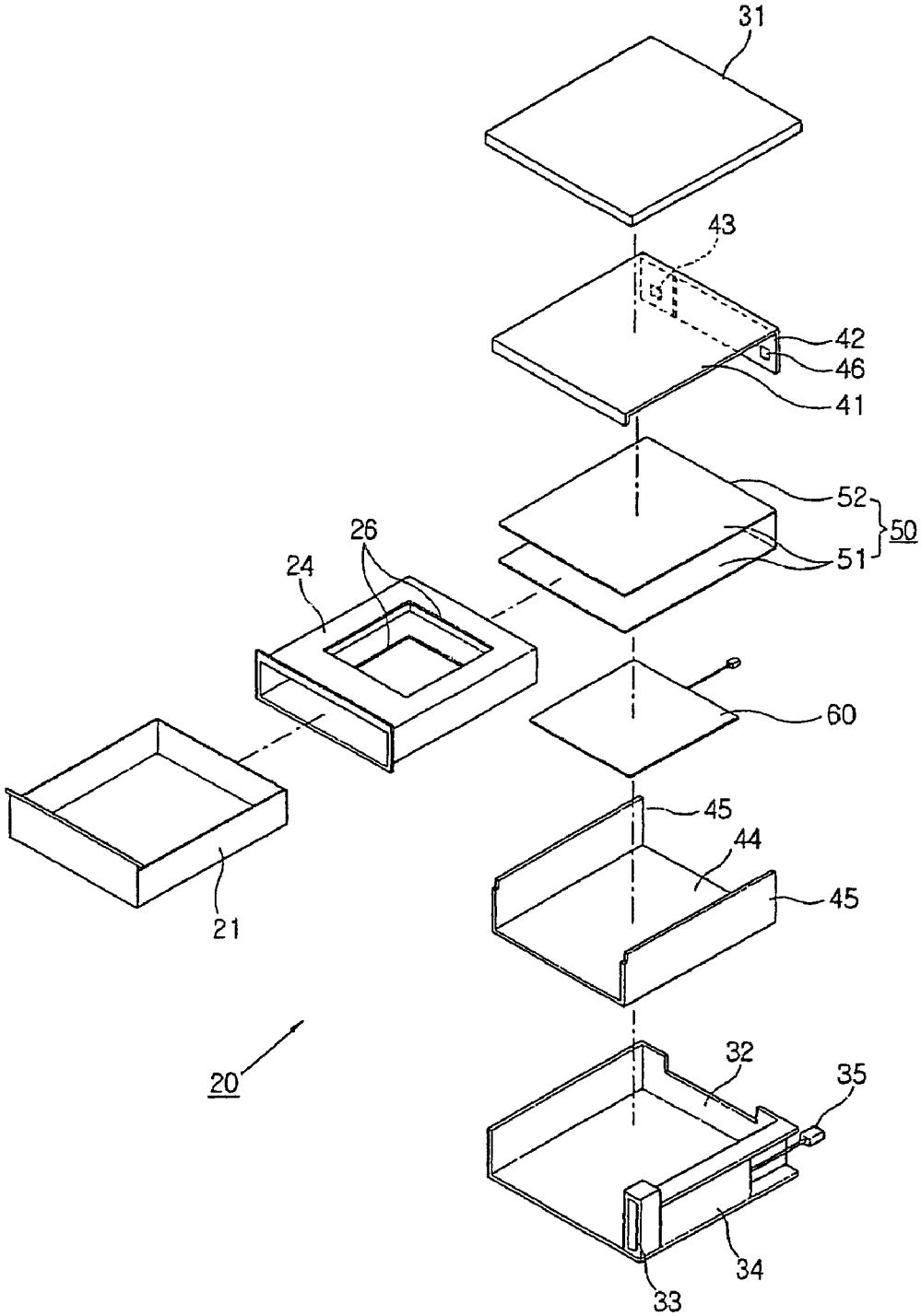
FIG. 2 is an exploded perspective view illustrating a sub storage compartment in FIG. 1.

As shown in FIGS. 1 and 2, a refrigerator 1 according to a first embodiment of the present invention includes a main body 2 forming an external appearance of the refrigerator 1, a machinery room 6 accommodated in the main body 2 of the refrigerator 1, an evaporator 7 partitioned with the machinery room 6, a cool air duct 8 through which cool air generated from the evaporator 7 flows, a fan 12 supplying cool air to the cool air duct 8, a freezing compartment (not shown) and a refrigerating compartment 9 supplied with cool air by the fan 12, and a sub storage compartment 20 separately provided inside the refrigerating compartment 9.

As shown in FIG. 2, the sub storage compartment 20 includes a separate accommodating part 24 having an opening 26 through which radiant heat is transferred, a heat transferring member 50 transferring heat into the separate accommodating part 24 through the opening 26, a sub cool air duct 25 (shown in FIG. 3) transmitting cool air from the cool air duct 8 to the heat transferring member 50, a heater 60 heating the heat transferring member 50, and a separate casing 23 (shown in FIG. 3) surrounding the separate accommodating part 24 to be insulated from the refrigerating compartment 9.

The main body 2 includes an outer cabinet 4 formed of metal to form an external appearance of the main body 2, and an inner cabinet 3 spaced from the outer cabinet 4 to form a space filled with a foaming material 5, for example, and formed of a plastic material to form the freezing compartment and the refrigerating compartment 9. While the material used in between the inner 3 and outer 4 cabinets is shown in FIG. 1 as a foaming material, any type of insulating material may be used.

The machinery room 6 includes a compressor 11 compressing a refrigerant to become a gas with a high temperature and a high pressure, and a condenser (not shown) condensing the gas flowed from the compressor 11. The machinery room 6 is divided from the evaporator 7 so that the evaporator 7 is prevented from being affected by heat generated from the compressor 11 and the condenser.

The evaporator 7 may be singly provided to supply cool air to the freezing compartment and the refrigerating compartment 9, or may be respectively provided to the freezing compartment and the refrigerating compartment 9 to supply cool air. The cool air generated by the evaporator 7 flows through the cool air duct 8. The evaporator 7 includes a refrigerant tube (not shown) through which refrigerant flows, and a cooling fin (not shown) maximizing contact between the refrigerant tube and surrounding air.

The cool air duct 8 guides the cool air generated from the evaporator 7 to the freezing compartment and the refrigerating compartment 9. The fan 12 is provided inside the cool air duct 8 to supply cool air to the freezing compartment and the refrigerating compartment 9. Also, the fan 12 may be operated to defrost the evaporator 7 while the compressor 11 is not operated. Here, the cool air duct 8 includes a main damper 29 to control cool air supplied to the refrigerating compartment 9 and a damper 28 to control air supplied to the sub storage compartment 20.

Figure 6:
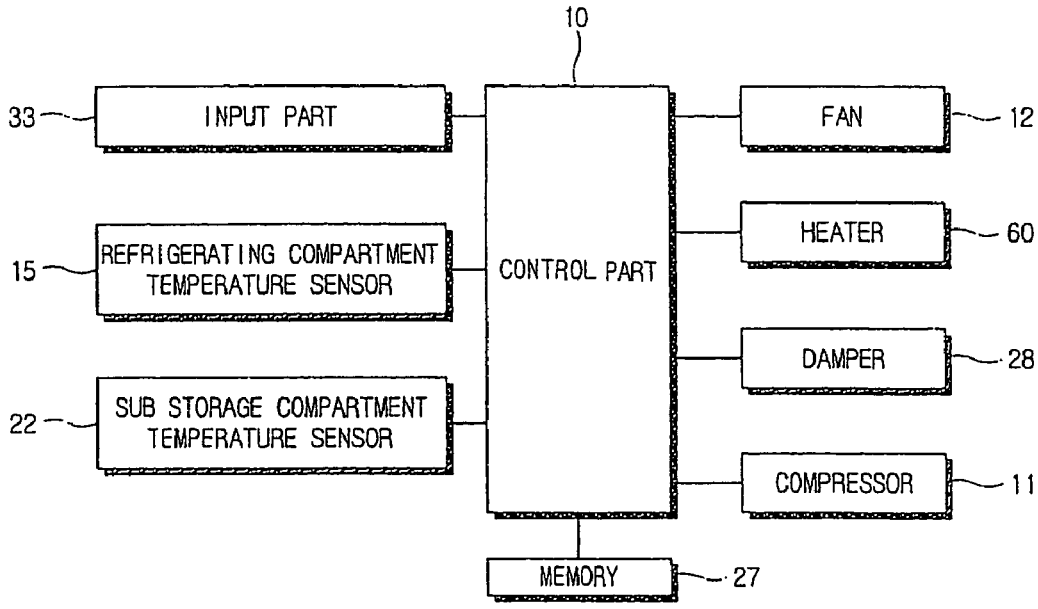
FIG. 6 is a control block diagram of the refrigerator in FIG. 1.

The refrigerating compartment 9 stores food at a temperature higher than the freezing compartment. The refrigerating compartment 9 includes, for example, a shelf 14 partitioning the refrigerating compartment 9 to conveniently store food, the sub storage compartment 20 independently provided in the refrigerating compartment 9, and a sub refrigerating compartment 13 storing food. Also, the refrigerating compartment 9 includes a refrigerating compartment temperature sensor 15, as shown in FIG. 6, sensing the temperature of the refrigerating compartment 9 in order to control the temperature thereof.

The sub storage compartment 20 is separately provided in an area of the refrigerating compartment 9, and the temperature thereof is independently controlled with respect to the refrigerating compartment 9. The sub storage compartment 20 may have a relatively higher temperature than the rest of the refrigerating compartment 9 to store food such as fermentative food, vegetables, fruits, etc.

As described in the following TABLE 1, the temperature of the sub storage compartment 20 may be controlled according to food.

TABLE 1

| Temperature | Food |
|---|---|
| 2° C. | broccoli, lettuce, strawberry and orange |
| 5° C. | watermelon, potato, cucumber, pimiento, tomato and green pumpkin |
| 10° C. | sweet potato and banana |

For example, the sub storage compartment 20 may be controlled to maintain the temperature to 2 degrees Celsius to store broccoli, for example, or 10 degrees Celsius to store bananas.

The sub storage compartment 20 may be independently controlled to have a temperature suitable to the food stored therein irrespective of the temperature of refrigerating compartment 9.

Figure 3:
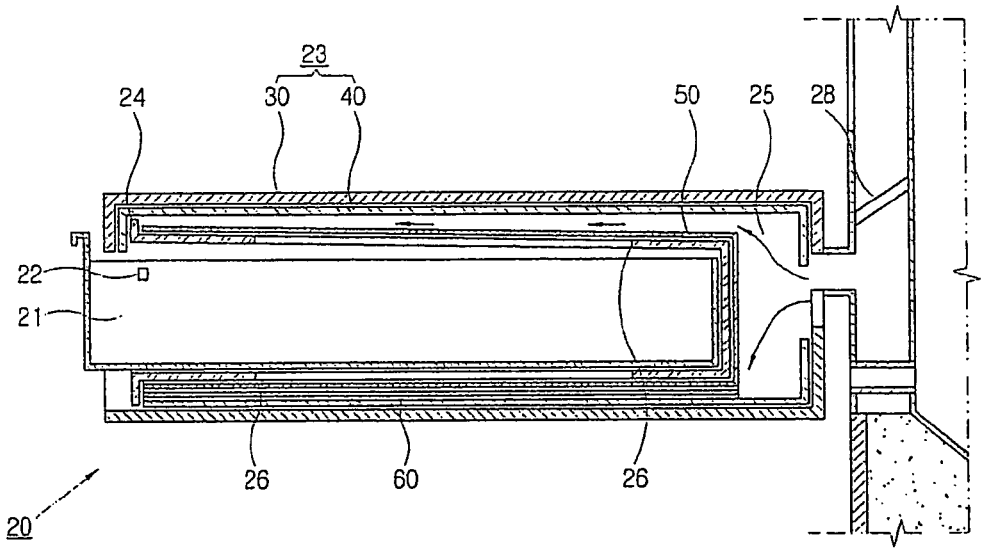
FIG. 3 is a combined sectional view illustrating the sub storage compartment in FIG. 2.

Hereinafter, a configuration of the sub storage compartment 20 will be described in detail by referring to FIGS. 2 and 3.

The sub storage compartment 20 includes the separate accommodating part 24 formed with the opening 26 through which heat is transferred by radiation so that a storage space of the sub storage compartment 20 is indirectly cooled or heated, the heat transferring member 50 transferring heat to an inside of the separate accommodating part 24 through the opening 26, the sub cool air duct 25 transmitting cool air guided through the cool air duct 8 to the heat transferring member 50, and the separate casing 23 surrounding the separate accommodating part 24 and the heat transferring member 50 so that the separate accommodating part 24 is insulated from the refrigerating compartment 9. Also, the sub storage compartment 20 includes the heater 60 to raise the temperature of the inside thereof.

Figure 4:
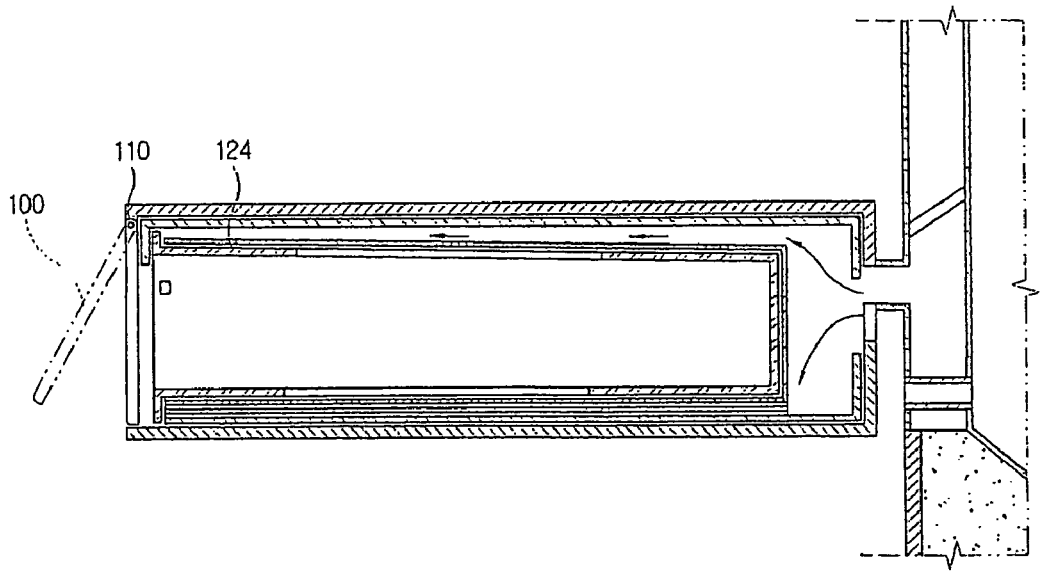
FIG. 4 is a sectional view illustrating a sub storage compartment of a refrigerator according to a second embodiment of the present invention.

The sub storage compartment 20 includes a storing part 21 slidably inserted therein or drawn therefrom. Alternatively, referring to FIG. 4, the sub storage compartment may include a sub storage compartment door 100 and a hinge part 110, and may be closed or opened by rotation of the sub storage compartment door 100. The sub storage compartment 20 is singly provided to a lower area of the refrigerating compartment 9, but alternatively, a plurality of sub storage compartments 20 may be provided according to the capacity of the refrigerator 1. The sub storage compartment includes a sub storage compartment temperature sensor 22, as shown in FIG. 3, sensing the temperature thereof.

The separate accommodating part 24 forms a space in which the storing part 21 is mounted, and is formed with the opening 26 through which heat or cold heat from the heat transferring member 50 is radiated. The storing part 21 stores food, and is slidably mounted to the separate accommodating part 24. The separate accommodating part 24 may be inclined downward from an entrance thereof to an opposite part thereof so that water condensed on a surface of the separate accommodating part 24 flows to the opposite part.

The opening 26 is provided between opposite sides of the separate accommodating part 24 and is elongated in a sliding direction of the storing part 21. However, alternatively, the opening 26 may be provided along a side of the separate accommodating part 24, and may be elongated in a transverse direction with respect to the sliding direction of the storing part 21.

The storing part 21 is able to store various foods, such as vegetables, fruits, fermentative food, etc. The storing part 21 is a drawer and is separately provided to the separate accommodating part 24. Alternatively, referring to FIG. 4, the storing part 21 may be omitted, and food may be directly stored in the separate accommodating part 124. The sub storage compartment door 100 opens and closes an entrance of the separate accommodating part 124.

The heat transferring member 50 is cooled by cool air supplied through the sub cool air duct 25, or heated by the heater 60 disposed under the heat transferring member 50, such that heat or cold heat from the heat transferring member 50 is transferred by radiation to the separate accommodating part 24 in which the storing part 21 is mounted. Thus, the separate accommodating part 24 is indirectly heated or cooled. Here, heat or cold heat of the heat transferring member 50 is efficiently transferred by radiation through the opening 26.

Also, the heat transferring member 50 includes a pair of first heat transferring parts 51 facing opposite sides of the separate accommodating part 24 in which the opening 26 is formed, and a second heat transferring part 52 bent from the first heat transferring parts 51 to face a rear side of the separate accommodating part 24. Thus, the heat transferring member 50 surrounds three sides of the separate accommodating part 24. However, alternatively, the heat transferring member 50 may surround all sides of the separate accommodating part 24, or one side thereof.

The heat transferring member 50 according to the embodiments of the present invention may be formed from aluminum having good thermal conductivity. However, alternatively, the heat transferring member 50 may be formed from any other metal having good thermal conductivity, such as copper, etc.

The separate casing 23 forms the sub cool air duct 25 transmitting cool air from the cool air duct 8 to the heat transferring member 50, and surrounds the separate accommodating part 24 to be insulated from the refrigerating compartment 9. The separate casing 23 includes an outer casing 30 forming an external appearance of the sub storage compartment 20, and an insulating member 40 insulating the separate accommodating part 24 from the refrigerating compartment 9. An input part 33 is provided on a front side of the separate casing 23 to set a desired temperature. The separate casing 23 is distanced from the heat transferring member 50 to form the sub cool air duct 25.

The outer casing 30 includes an upper casing 31 and a lower casing 32 oppositely disposed to interpose the separate accommodating part 24 therebetween. The upper casing 31 covers an upper insulating member 41. The input part 33 is provided on the lower casing 32, and includes a printed circuit board 34. However, alternatively, the input part 33 may be provided on a display part (not shown) of a door 16 of the refrigerator 1. The lower casing 32 includes a power supplying part 35 supplying power to the printed circuit board 34.

The insulating member 40 includes the upper insulating member 41 and a lower insulating member 44 oppositely disposed to interpose the separate accommodating part 24 therebetween. The insulating member 40 insulates the heat transferring member 50 from the refrigerating compartment 9.

The upper insulating member 41 includes a bent part 42 bent to face the second heat transferring part 52. The upper insulating member 41 is distanced from the first heat transferring part 51 and the second heat transferring part 52 to form the sub cool air duct 25. The bent part 42 of the upper insulating member 41 is formed with a cool air inlet 43 through which cool air flows in to be transmitted to the heat transferring member 50, and a cool air outlet 46, through which warmed air flows out. The cool air inlet 43 and the cool air outlet 46 are respectively singly formed, but alternatively, a plurality of cool air inlets 43 and cool air outlets 46 may be formed.

Cool air supplied from the cool air duct 8 flows through the cool air inlet 43 and the sub cool air duct 25 to be transmitted to the heat transferring member 50. Thus, the heat transferring member 50 is cooled by the cool air, and accordingly, indirectly cools an inside of the separate accommodating part 24 by radiation.

The lower insulating member 44 includes side insulating parts 45 bent from a plane of the lower insulating member 44 to contact and cover the opposite sides of the separate accommodating part 24. The side insulating parts 45 contact with the heat transferring member 50 and insulate the heat transferring member 50 from the refrigerating compartment 9.

The heater 60 may be interposed between the lower insulating member 44 and the heat transferring member 50. However, alternatively, the heater 60 may be disposed to other positions according to configurations of the insulating member 40 and the heat transferring member 50. Also, the heater 60 has a planar shape, but alternatively, the heater 60 may have a coil shape, or other shapes. The heater 60 heats the heat transferring member 50, and accordingly, heat from the heat transferring member 50 is transferred by radiation to an inside of the separate accommodating part 24 so that the temperature of the sub storage compartment 20 rises.

Figure 5:
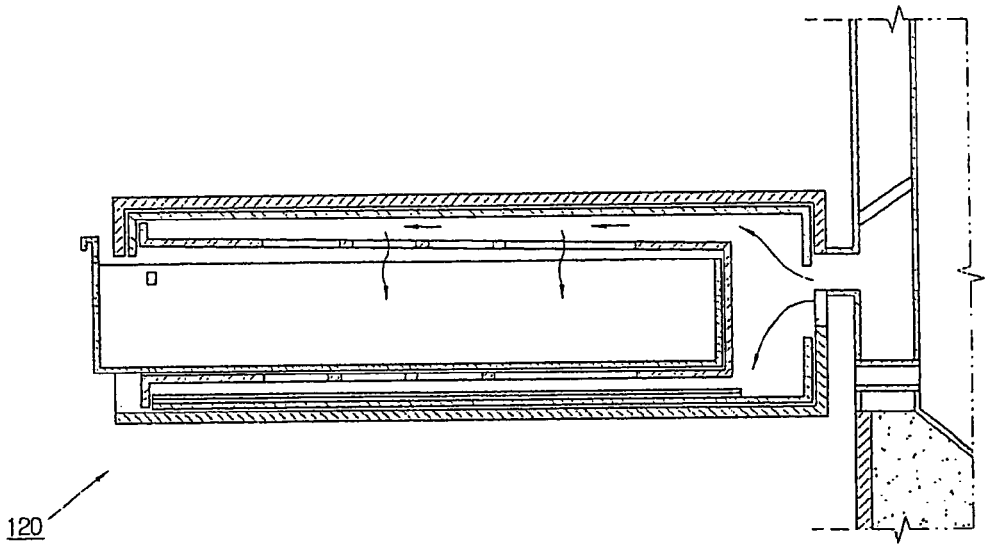
FIG. 5 is a sectional view illustrating a sub storage compartment of a refrigerator according to a third embodiment of the present invention.

The sub storage compartment 20 is indirectly cooled or heated by radiation of heat or cold heat to or from the heat transferring member 50. However, alternatively, referring to FIG. 5, cool air or heated air may be directly supplied into a sub storage compartment 120, and an operating method for a refrigerator according to the embodiments of present invention can be applied thereto.

As shown in FIG. 6, the input part 33 transmits a temperature value set by a user to a control part 10. The control part 10 may store the set temperature to a memory 27 as necessary.

The memory 27 stores a set temperature inputted through the input part 33 with respect to the sub storage compartment 20 and the refrigerating compartment 9. The set temperatures stored in the memory 27 may be transmitted to the control part 10.

The control part 10 controls the temperature of the storing part 21 according to a set temperature inputted through the input part 33 and a signal from the sub storage compartment temperature sensor 22. The control part 10 determines a maximum temperature, an upper limit temperature, a minimum temperature and a lower limit temperature based on a set temperature inputted through the input part 33, and on/off controls a damper 28 and on/off of the heater 60 according to the temperatures determined by the control part 10.

Hereinafter, an operating method for the refrigerator 1 including the sub storage compartment 20 according to a first embodiment of the present invention will be described by referring to FIGS. 7A and 7B.

The control part 10 determines a maximum temperature, an upper limit temperature, a minimum temperature and a lower limit temperature based on a set temperature inputted by a user. Here, the maximum temperature refers to a temperature at which the heater 60 is turned off when the sub storage compartment 20 is heated in a forced heating mode, and the upper limit temperature refers to a temperature at which the damper 28 of the cool air duct 8 is opened to cool the sub storage compartment 20 to enter a forced cooling mode. Also, the minimum temperature refers to a temperature at which the heater 60 is turned on in a natural cooling mode or the damper 28 of the cool air duct 8 is closed in the forced cooling mode, and the lower limit temperature refers to a temperature at which the heater 60 is turned on when the temperature of the sub storage compartment 20 decreases after the damper 28 is closed in the forced cooling mode. The upper limit temperature is higher than the maximum temperature, and the lower limit temperature is lower than the minimum temperature. The upper limit temperature may be higher than the maximum temperature by 1 degree Celsius, for example, and the lower limit temperature may be lower than the minimum temperature by 1 degree, for example.

Also, the natural cooling mode refers to an operating mode in which the temperature of the sub storage compartment 20 naturally decreases. For example, if the temperature of the sub storage compartment 20 is higher than that of the refrigerating compartment 9, the temperature of the sub storage compartment 20 may decrease due to thermal interaction with the refrigerating compartment 9. The forced cooling mode refers to an operating mode in which the damper 28 is opened to supply cool air to the sub storage compartment 20. For example, if the temperature of the sub storage compartment 20 is lower than that of the refrigerating compartment 9, the sub storage compartment 20 cannot be naturally cooled by the atmosphere of the refrigerating compartment 9. Instead, the temperature of the sub storage compartment 20 is decreased through the forced cooling mode.

Also, the natural heating mode refers to an operating mode in which the temperature of the sub storage compartment 20 naturally increases. For example, if the temperature of the sub storage compartment 20 is lower than that of the refrigerating compartment 9, the temperature of the sub storage compartment 20 may increase by the refrigerating compartment 9. The forced heating mode refers to an operating mode in which the heater 60 is turned on to supply heat to the sub storage compartment 20. For example, if the temperature of the sub storage compartment 20 is higher than that of the refrigerating compartment 9, the sub storage compartment 20 cannot be naturally heated by the refrigerating compartment 9. Instead, the temperature of the sub storage compartment 20 is increased through the forced heating mode.

The control part 10 controls the heater 60 and the damper 28 based on the temperature sensed by the sub storage compartment temperature sensor 22 to correspond to a set temperature inputted by a user.

Figure 7A:
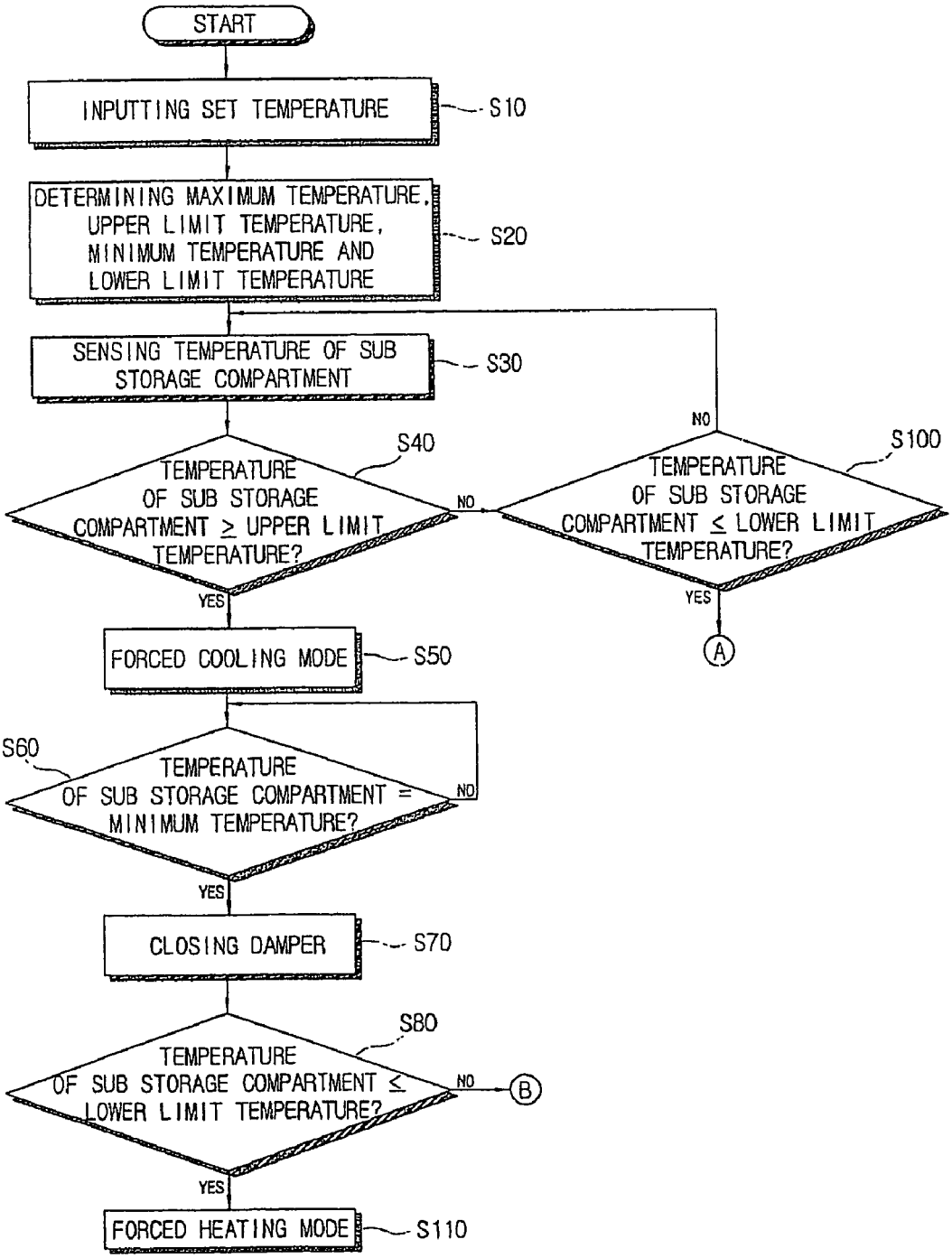
FIGS. 7A and 7B are a control flow chart of an operating method for a refrigerator according to a first embodiment of the present invention.
Figure 7B:
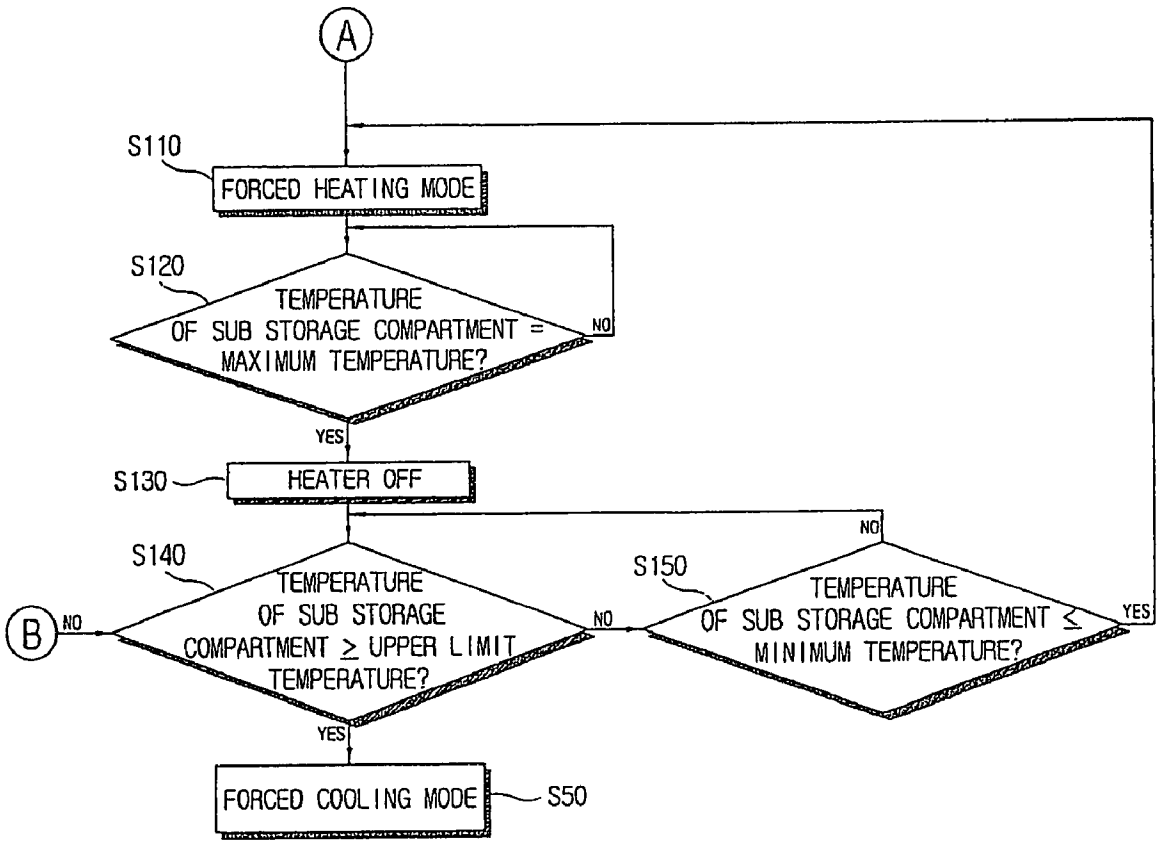

Referring to FIGS. 7A and 7B, a set temperature is inputted by a user (S10).

Then, the control part 10 determines a maximum temperature, an upper limit temperature, a minimum temperature and a lower limit temperature based on the set temperature (S20).

The control part 10 continually senses the temperature of the sub storage compartment 20 through the sub storage compartment temperature sensor 22 (S30). Then, the control part 10 compares the sensed temperature of the sub storage compartment 20 with the upper limit temperature (S40). If the temperature of the sub storage compartment 20 is greater than or equal to the upper limit temperature, the control part 10 opens the damper 28 of the cool air duct 8 so that cool air is supplied to the heat transferring member 50 through the sub cool air duct 25. Thus, the sub storage compartment 20 is forcedly cooled (S50).

Then, the control part 10 determines whether the temperature of the sub storage compartment 20 decreases to the minimum temperature or not (S60). If the temperature of the sub storage compartment 20 reaches the minimum temperature, the control part 10 closes the damper 28 (S70).

Then, the control part 10 determines whether the sub storage compartment 20 is cooled below the lower limit temperature or not (S80). If the sub storage compartment 20 is cooled to equal or less than the lower limit temperature, the control part 10 turns on the heater 60 (S110). If the sub storage compartment 20 is not cooled to equal or less than the lower limit temperature, the control part 10 determines that the sub storage compartment 20 is naturally heated by the atmosphere of the refrigerating compartment 9, and determines whether the temperature of the sub storage compartment 20 is equal to or higher than the upper limit temperature or not (S140).

In the stage that the control part 10 compares the temperature of the sub storage compartment 20 with the upper limit temperature (S40), if the temperature of the sub storage compartment 20 is lower than the upper limit temperature, the control part 10 determines whether the sub storage compartment 20 is cooled to or below the lower limit temperature or not (S100). If the sub storage compartment 20 is cooled to or below the lower limit temperature, the control part 10 closes the damper 28 and turns on the heater 60 (S110). Then, the control part 10 determines whether the temperature of the sub storage compartment 20 increases to the maximum temperature or not (S120). If the temperature of the sub storage compartment 20 reaches the maximum temperature, the control part 10 turns off the heater 60 (S130).

After the heater 60 is turned off, it is necessary to determine whether the sub storage compartment 20 is naturally cooled by the atmosphere of the refrigerating compartment 9 or not. Thus, the control part 10 determines whether the temperature of the sub storage compartment 20 is equal to or higher than the upper limit temperature or not (S140). If the temperature of the sub storage compartment 20 is equal to or higher than the upper limit temperature, the control part 10 enters the forced cooling mode (S50). If the temperature of the sub storage compartment 20 is lower than the upper limit temperature, the control part 10 determines that the sub storage compartment 20 is naturally cooled by the atmosphere of the refrigerating compartment 9, and determines whether the sub storage compartment 20 is cooled to or below the minimum temperature or not (S150). If the sub storage compartment 20 is cooled to or below the minimum temperature, the control part 10 enters the forced heating mode (S110). If the sub storage compartment 20 is not cooled to or below the minimum temperature, the control part 10 enters the stage of S140.

Accordingly, temperature variation of the sub storage compartment 20 can be minimized to enhance the freshness of food stored therein, and heating and cooling can be minimized to reduce power consumption.

Hereinafter, an effect of the operating method for the refrigerator 1 according to the first embodiment of the present invention will be described by referring to FIGS. 8 and 9. Here, as an example, the difference between the upper limit temperature and the maximum temperature and the difference between the lower limit temperature and the minimum temperature are both 1 degree Celsius.

Figure 8:
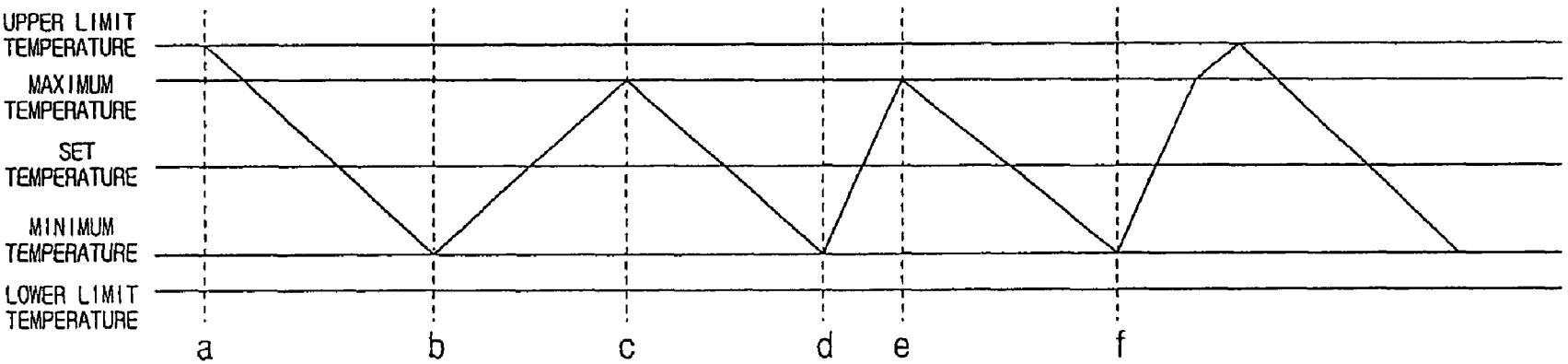
FIG. 8 illustrates a first temperature variation of a sub storage compartment according to the operating method in FIGS. 7A and 7B.

Referring to FIG. 8, in period a-b, if the initial temperature of the sub storage compartment 20 is equal to or higher than the upper limit temperature, the damper 28 is opened to forcedly cool the sub storage compartment 20. In period b-c, the damper 28 is closed at time b, and the sub storage compartment 20 is naturally heated by the refrigerating compartment 9. In period c-d, the sub storage compartment 20 is naturally cooled by the refrigerating compartment 9. Here, the sub storage compartment 20 may be naturally heated or cooled according to the temperature variation of the refrigerating compartment 9. The temperature of the refrigerating compartment 9 may vary according to the heat source, such as food, etc. inside the refrigerating compartment 9, opening of a door thereof, supplying of cool air from the cool air duct 8, etc. In period d-e, since the temperature of the sub storage compartment 20 reaches the minimum temperature, the heater 60 is turned on to forcedly heat the sub storage compartment 20. In period e-f, after the heater 60 is turned off at time e, the sub storage compartment 20 is naturally cooled. Thus, the heater 60 is turned off at the maximum temperature, and on at the minimum temperature. Accordingly, the sub storage compartment 20 can be controlled to have a temperature between the maximum temperature and the minimum temperature, and thereby minimizing temperature variation thereof.

Figure 9:
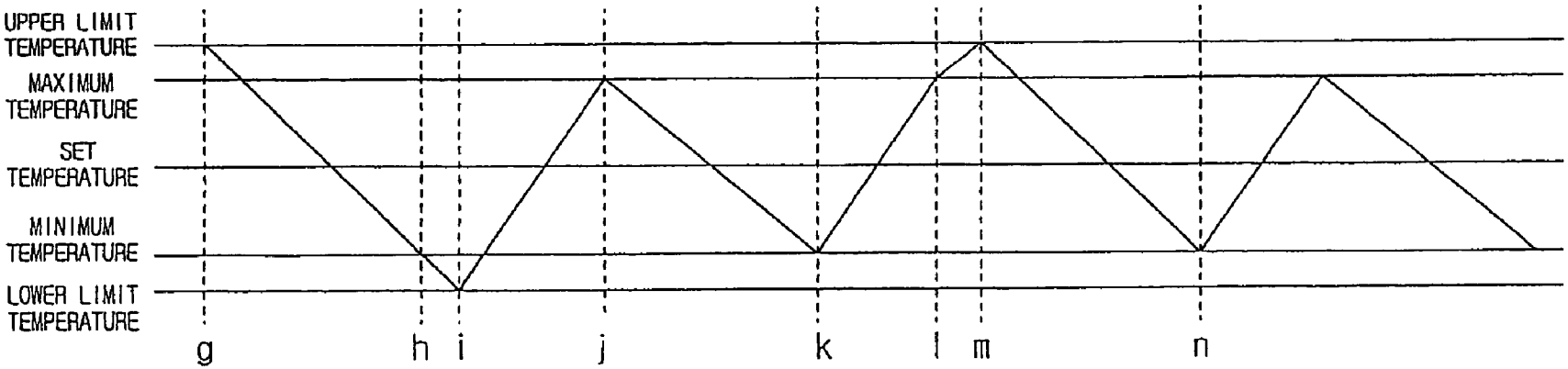
FIG. 9 illustrates a second temperature variation of a sub storage compartment according to the operating method in FIGS. 7A and 7B.

Referring to FIG. 9, in period g-h, if the initial temperature of the sub storage compartment 20 is equal to or higher than the upper limit temperature, the damper 28 is opened to forcedly cool the sub storage compartment 20. In period h-i, after the damper 28 is closed at time h, the sub storage compartment 20 is naturally cooled to reach the lower limit temperature by the atmosphere of the refrigerating compartment 9 instead of being naturally heated. In period i-j, the heater 60 is turned on to enter the forced heating mode, and when the temperature of the sub storage compartment 20 reaches the maximum temperature, the heater 60 is turned off. In period j-k, after the heater 60 is turned off, the sub storage compartment 20 is naturally cooled by the refrigerating compartment 9 instead of being naturally heated to reach the upper limit temperature. In period k-l, when the temperature of the sub storage compartment 20 reaches the minimum temperature, the heater 60 is turned on to forcedly heat the sub storage compartment 20, and when the temperature of the sub storage compartment 20 reaches the maximum temperature, the heater 60 is turned off. In period l-m, after the heater 60 is turned off, the sub storage compartment 20 is naturally heated to reach the upper limit temperature by the atmosphere of the refrigerating compartment 9 instead of being naturally cooled. In period m-n, the damper 28 is opened at time m to forcedly cool the sub storage compartment 20.

Figure 10:
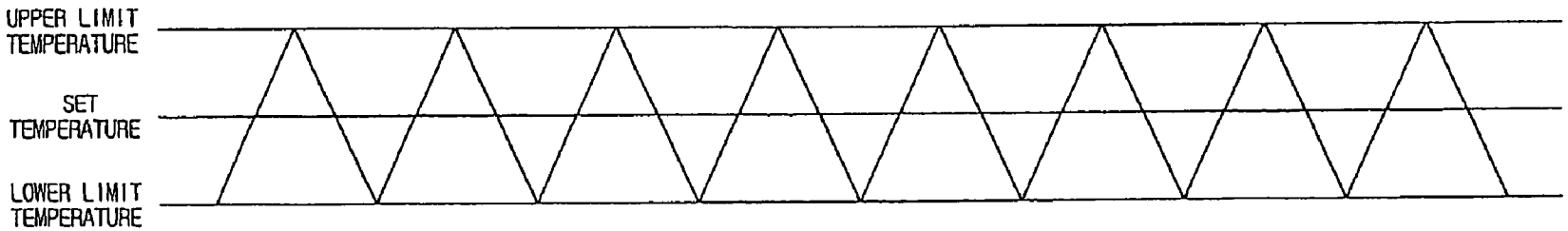
FIG. 10 illustrates temperature variation of a sub storage compartment according to a conventional operating method for a refrigerator.

As compared with the conventional operating method of FIG. 10, temperature variation of the sub storage compartment 20 by the operating method according to the first embodiment of the present invention is less. Also, in the conventional operating method, the sub storage compartment is forcedly cooled and forcedly heated. However, in the operating method according to the first embodiment of the present invention, the sub storage compartment 20 is naturally heated or cooled by a temperature difference between the sub storage compartment 20 and the refrigerating compartment 9, without being supplied with additional power. Thus, power consumption of the operating method according to the first embodiment of the present invention is less than that of the conventional operating method.

Hereinafter, an operating method for the refrigerator 1 including the sub storage compartment 20 according to a second embodiment of the present invention will be described by referring to FIGS. 11A and 11B.

Figure 11A:
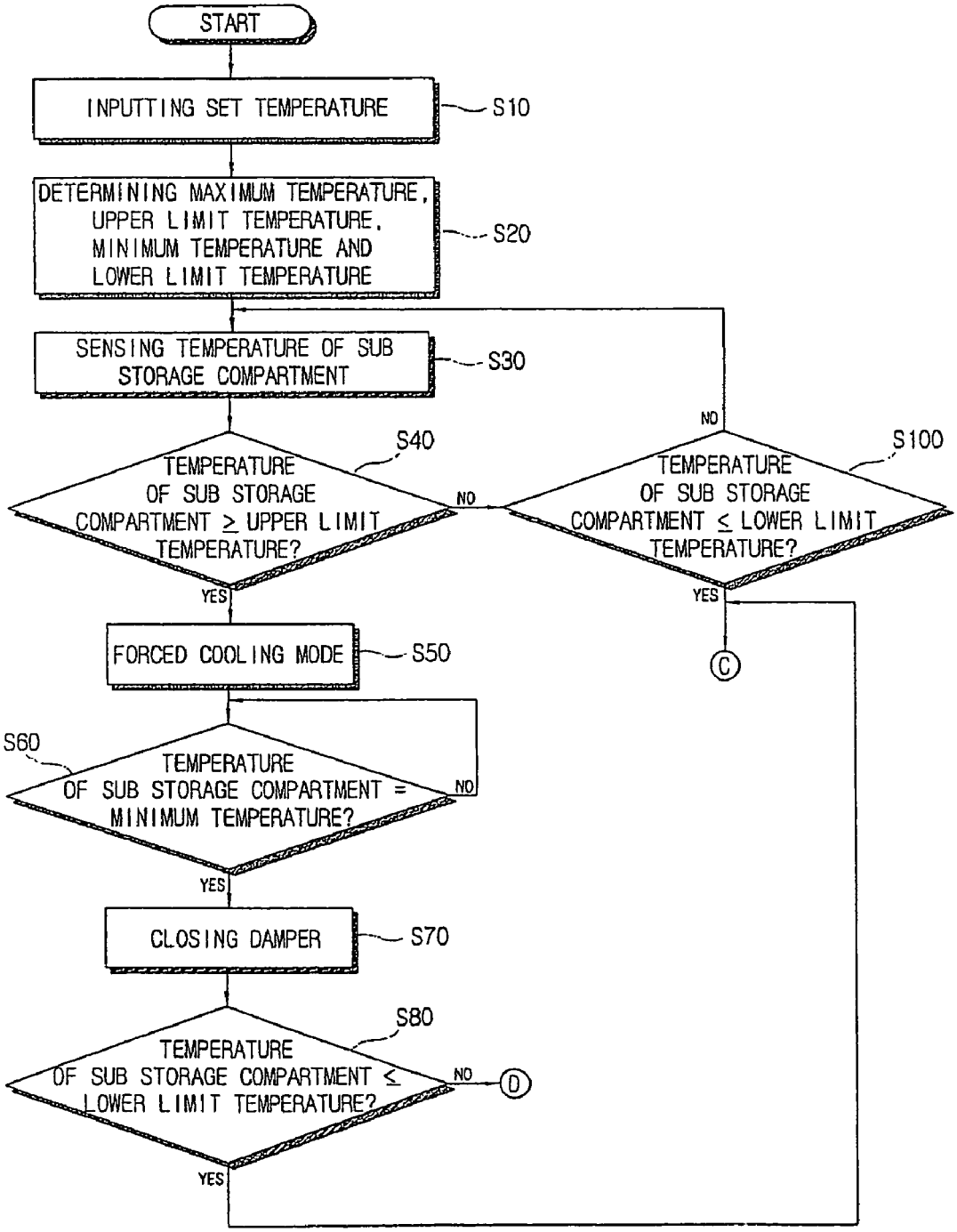
FIGS. 11A and 11B are a control flow chart of an operating method for a refrigerator according to a second embodiment of the present invention.
Figure 11B:
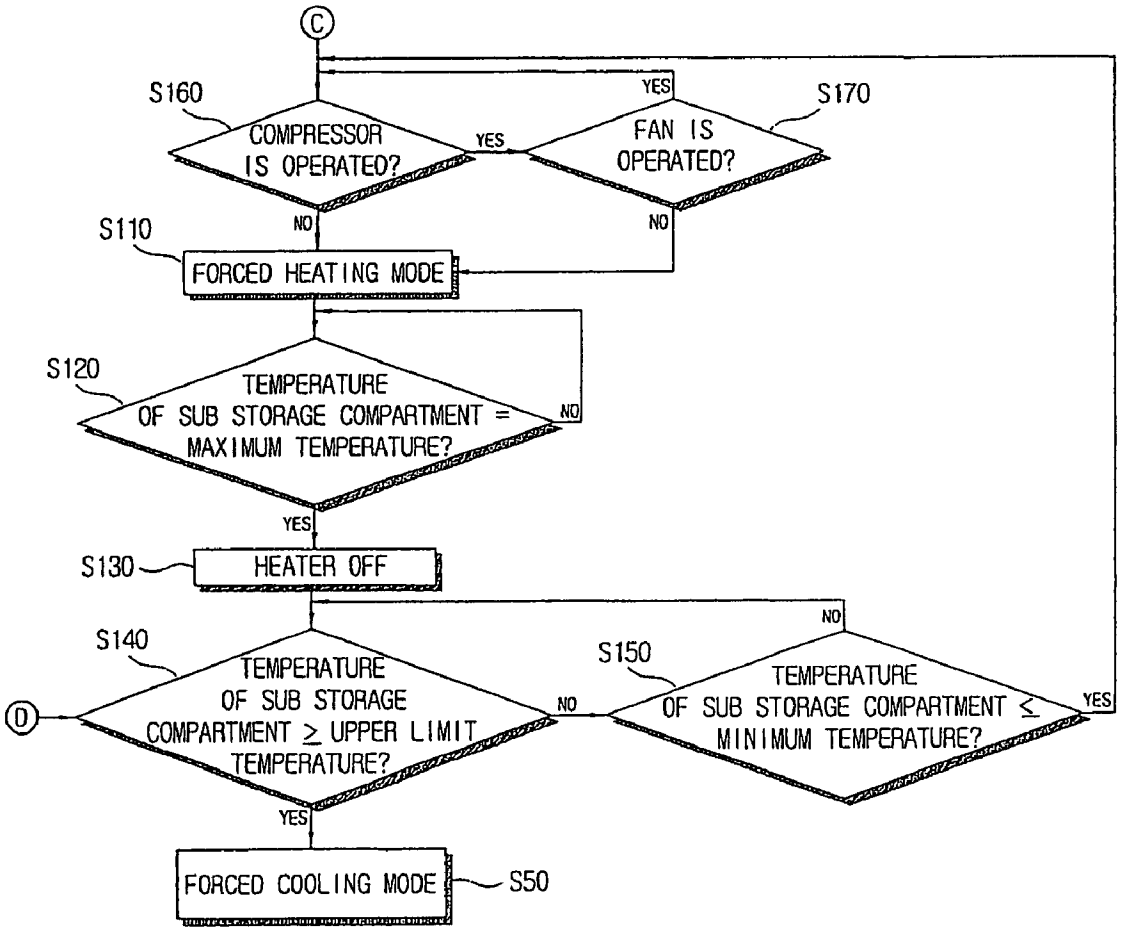

Referring to FIGS. 11A and 11B, in an operating method for the refrigerator 1 according to a second embodiment of the present invention, the heater 60 is turned on/off according to a state of the refrigerating compartment 9.

Hereinafter, the same operating method for the refrigerator 1 according to the first embodiment of the present invention is omitted from the description of the second embodiment of the present invention that uses the same operations. If an initial temperature of the sub storage compartment 20 is equal to or higher than an upper limit temperature (S40), the sub storage compartment 20 is forcedly cooled (S50). Then, if the damper has been closed (S70), if the temperature of the sub storage compartment 20 is lower than or equal to a lower limit temperature (S80), the control part 10 determines whether the compressor 11 is operated or not (S160) instead of directly entering the forced heating mode. Also, if an initial temperature of the sub storage compartment 20 is lower than or equal to the lower limit temperature (S100), the control part 10 determines whether the compressor 11 is operated or not (S160) instead of directly entering the forced heating mode. Also, if the sub storage compartment 20 is naturally cooled to reach a minimum temperature (S150), the control part 10 determines whether the compressor 11 is operated or not (S160) instead of directly entering the forced heating mode.

After the control part 10 determines whether the compressor 11 is operated or not (S160), if the compressor 11 is not operated, the control part 10 enters the forced heating mode (S110) irrespective of the operation of the fan 12 of the refrigerating compartment 9. If the compressor 11 is not operated, the refrigerator 9 is not supplied with cool air. However, the fan 12 may be operated to merely remove frost. Thus, although the heater 60 is turned on, energy efficiency does not deteriorate. If the compressor 11 is operated, the control part 10 determines whether the fan 12 is operated or not (S170). If the fan 12 is not operated, the control part 10 enters the forced heating mode (S110). If the fan 12 is operated, since the refrigerating compartment 9 is being supplied with cool air, the control part 10 does not enter the forced heating mode.

Accordingly, water in food stored in the refrigerating compartment 9 can be prevented from being evaporated, thereby preserving the food stored in the refrigerating compartment 9.

Also, cool air supplied to the refrigerating compartment 9 and operation of the heater 60 can be prevented from coinciding, thereby enhancing energy efficiency.

As described above, a refrigerator and an operating method therefor according to the embodiments of the present invention set temperature suitable for food to be stored. Then, based on the set temperature, the refrigerator and the operating method therefor according to the embodiments of the present invention can heat a sub storage compartment by forcedly heating through a heater or by naturally heating it by the temperature difference between the sub storage compartment and a refrigerating compartment, and can cool the sub storage compartment by forcedly cooling by supplying cool air or by naturally cooling by the temperature difference between the sub storage compartment and the refrigerating compartment. Thus, a forced cooling operation and a forced heating operation can be minimized, thereby reducing power consumption.

Further, while the refrigerating compartment is supplied with cool air, the heater can be prevented from heating the sub storage compartment, thereby enhancing energy efficiency. In addition, temperature variation of the sub storage compartment can be minimized, thereby storing food for longer periods of time.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator, comprising:

a refrigerating compartment;

a storage compartment located in the refrigerating compartment, including — a storing part, a temperature of which is independently controlled relative to a temperature of the refrigerating compartment, an accommodating part including walls, an upper opening formed in an upper one of the walls to transmit chill, a lower opening formed in a lower one of the walls to transmit heat, and a first space defined within the walls to receive the storing part, a heat transferring member extending across the upper opening and the lower opening to entirely cover the upper opening and lower opening, an insulation member positioned outwardly of the heat transferring member with a second space formed between the insulation member and the heat transferring member, wherein the insulation member insulates the accommodating part from the refrigerating compartment, a heater positioned in the second space adjacent to the heat transferring member;

a duct supplying chill to the storage compartment;

a damper controlling the supply of the chill to the storage compartment; and a controller controlling at least one of the damper and the heater, wherein the heat transferring member is selectively heated by receiving heat from the heater and selectively cooled by receiving the chill from the duct, and wherein the heat transferring member indirectly transfers the chill or the heat via radiation to the storing part through the upper opening and the lower opening in the accommodating part.

2. The refrigerator according to claim 1, wherein the storage compartment further comprises:

a sub chill duct connected with the chill duct to supply the chill to the heat transferring member, a second damper opening or closing a connection between the sub chill duct and the chill duct.

3. The refrigerator according to claim 2, wherein the insulation member comprises an inlet through which the chill flows in the sub chill duct, and an outlet through which warmed air flows out of the sub chill duct.

4. The refrigerator according to claim 1, wherein the heat transferring member comprises at least one of aluminum and copper.

5. The refrigerator according to claim 1, wherein the accommodating part is inclined so that water condensed thereto flows down the accommodating part.

6. The refrigerator according to claim 1, wherein the accommodating part includes an outer casing for the storage compartment.

* * * * *

UNITED STATES PATENT AND TRADEMARK OFFICE

CERTIFICATE OF CORRECTION

PATENT NO. : 8,028,538 B2
APPLICATION NO. : 11/653228
DATED : October 4, 2011
INVENTOR(S) : Kim et al.

It is certified that error appears in the above-identified patent and that said Letters Patent is hereby corrected as shown below:

Title Page Item (54) Column 2 (Title), Line 1-3, Delete "REFRIGERATOR WITH TEMPERATURE CONTROL AND OPERATING METHOD THEREFOR" and insert -- REFRIGERATOR WITH TEMPERATURE CONTROL --, therefor.

Column 1, Line 1-3, Delete "REFRIGERATOR WITH TEMPERATURE CONTROL AND OPERATING METHOD THEREFOR" and insert -- REFRIGERATOR WITH TEMPERATURE CONTROL --, therefor.

Signed and Sealed this
Sixth Day of March, 2012

David J. Kappos

David J. Kappos
*Director of the United States Patent and Trademark Office*